US008747566B2

(12) United States Patent
Rice et al.

(10) Patent No.: US 8,747,566 B2
(45) Date of Patent: Jun. 10, 2014

(54) EFFLUENT COLLECTION UNIT FOR ENGINE WASHING

(71) Applicant: United Technologies Corporation, Hartford, CT (US)

(72) Inventors: Robert M. Rice, Huntsville, AL (US); David G. Diamos, El Paso, TX (US); William J. Welch, Madison, CT (US)

(73) Assignee: EcoServices, LLC, Wethersfield, CT (US)

( * ) Notice: Subject to any disclaimer, the term of this patent is extended or adjusted under 35 U.S.C. 154(b) by 16 days.

(21) Appl. No.: 13/632,375

(22) Filed: Oct. 1, 2012

(65) Prior Publication Data

US 2013/0019898 A1 Jan. 24, 2013

Related U.S. Application Data

(62) Division of application No. 12/002,981, filed on Dec. 19, 2007, now Pat. No. 8,277,647.

(51) Int. Cl.
*B08B 7/00* (2006.01)

(52) U.S. Cl.
USPC ..... 134/6; 134/10; 134/34; 210/241; 210/248

(58) Field of Classification Search
None
See application file for complete search history.

(56) References Cited

U.S. PATENT DOCUMENTS

| | | | |
|---|---|---|---|
| 2,689,456 | A | 9/1954 | White |
| 2,755,517 | A | 7/1956 | Sickel |
| 2,856,225 | A | 10/1958 | Selzer |
| 2,981,266 | A | 4/1961 | Tamburri |
| 2,997,048 | A | 8/1961 | Gertken et al. |
| 3,258,019 | A | 6/1966 | Bellas et al. |
| 3,289,238 | A | 12/1966 | Sorenson et al. |
| 3,444,867 | A | 5/1969 | Thornton |
| 3,564,820 | A | 2/1971 | Nelson |
| 3,620,564 | A | 11/1971 | Wenger et al. |
| 3,623,668 | A | 11/1971 | Freid et al. |
| 3,768,858 | A | 10/1973 | Boismier |
| 3,774,625 | A | 11/1973 | Wiltrout |
| 3,836,769 | A | 9/1974 | Wilson |

(Continued)

FOREIGN PATENT DOCUMENTS

| | | | |
|---|---|---|---|
| EP | 0628477 | A1 | 12/1994 |
| EP | 0933144 | A2 | 8/1999 |

(Continued)

OTHER PUBLICATIONS

49 CFR 571.108, Federal Motor Vehicle Safety Standards; [online] Oct. 1, 2007, retrieved from the Internet: <URL:http//frwebgate.access.gpo.gov/cgi-bin/get-cfr.cgi> Entire document, esp. Table 1.

(Continued)

*Primary Examiner* — Eric Golightly
(74) *Attorney, Agent, or Firm* — Kinney & Lange, P.A.

(57) ABSTRACT

A method for collecting effluent from an engine comprising: providing a portable trailer having a plurality of sides in a retracted and non-operational configuration forming an internal compartment and at least one droplet separator panel; and moving at least two of said sides from said retracted and non-operational configuration to an open position and an operational configuration wherein said two sides create a path for channeling an effluent/air mixture containing engine wash water from said engine to said at least one droplet separator panel; and separating said engine wash water from said air with said at least one droplet separator panel.

10 Claims, 6 Drawing Sheets

(56) References Cited

U.S. PATENT DOCUMENTS

| | | | |
|---|---|---|---|
| 3,911,938 | A | 10/1975 | Wiltrout |
| 3,923,658 | A | 12/1975 | Lancaster |
| 4,029,114 | A | 6/1977 | Wiltrout |
| 4,059,123 | A | 11/1977 | Bartos et al. |
| 4,065,322 | A | 12/1977 | Langford |
| 4,133,572 | A | 1/1979 | Robbins et al. |
| 4,196,020 | A | 4/1980 | Hornak et al. |
| 4,225,188 | A | 9/1980 | McGuire et al. |
| 4,279,263 | A | 7/1981 | Pulliam |
| 4,638,166 | A | 1/1987 | Baudro |
| 4,695,087 | A | 9/1987 | Hollrock |
| 4,976,485 | A | 12/1990 | Jonckheere |
| 5,011,540 | A | 4/1991 | McDermott |
| 5,026,112 | A | 6/1991 | Rice |
| 5,137,555 | A | 8/1992 | Fewel, Jr. |
| 5,152,109 | A | 10/1992 | Boers |
| 5,152,545 | A | 10/1992 | Hupperts et al. |
| 5,265,394 | A | 11/1993 | Gardner |
| 5,273,395 | A | 12/1993 | McDermott |
| 5,300,131 | A | 4/1994 | Richard |
| 5,330,579 | A | 7/1994 | Rushing et al. |
| 5,344,159 | A | 9/1994 | Powell |
| 5,374,352 | A | 12/1994 | Pattee |
| 5,462,655 | A | 10/1995 | Ladd et al. |
| 5,498,329 | A | 3/1996 | Lamminen et al. |
| 5,556,535 | A | 9/1996 | Van Der Est |
| 5,868,860 | A | 2/1999 | Asplund |
| 5,899,217 | A | 5/1999 | Testman, Jr. |
| 6,017,377 | A | 1/2000 | Brown et al. |
| 6,021,792 | A | 2/2000 | Petter et al. |
| 6,029,312 | A | 2/2000 | Whitney |
| 6,036,249 | A | 3/2000 | Kuntz |
| 6,065,792 | A | 5/2000 | Sciullo et al. |
| 6,073,637 | A | 6/2000 | Hayward et al. |
| 6,101,750 | A | 8/2000 | Blesener et al. |
| 6,176,495 | B1 | 1/2001 | Decker |
| 6,312,504 | B1 | 11/2001 | Both et al. |
| 6,393,769 | B1 | 5/2002 | Mertik et al. |
| 6,402,855 | B1 | 6/2002 | Damron et al. |
| 6,446,997 | B1 | 9/2002 | Bergman et al. |
| 6,470,668 | B2 | 10/2002 | Payling et al. |
| 6,478,033 | B1 | 11/2002 | Foster |
| 6,491,048 | B1 | 12/2002 | Foster |
| 6,503,334 | B2 | 1/2003 | Ruiz et al. |
| 6,553,768 | B1 | 4/2003 | Trewin et al. |
| 6,565,758 | B1 | 5/2003 | Thomas |
| 6,630,198 | B2 | 10/2003 | Ackerman et al. |
| 6,834,882 | B1 | 12/2004 | Boyd |
| 6,926,347 | B2 | 8/2005 | Fior et al. |
| 6,932,093 | B2 | 8/2005 | Ogden et al. |
| 6,945,343 | B1 | 9/2005 | Moreau et al. |
| 6,968,653 | B2 | 11/2005 | Stapleton, Jr. |
| 6,972,689 | B1 | 12/2005 | Morgan et al. |
| 7,052,033 | B2 | 5/2006 | McDonell |
| 7,059,666 | B2 | 6/2006 | Harrison |
| 7,109,885 | B1 | 9/2006 | Denlinger |
| 7,175,205 | B2 | 2/2007 | Simpson |
| 7,198,052 | B2 | 4/2007 | Watt |
| 7,297,260 | B2 | 11/2007 | Hjerpe et al. |
| 7,445,677 | B1 | 11/2008 | Asplund |
| 2001/0037591 | A1 | 11/2001 | Nicholson et al. |
| 2002/0124874 | A1 | 9/2002 | Butler |
| 2002/0153747 | A1 | 10/2002 | Ropp |
| 2002/0175881 | A1 | 11/2002 | Luoma et al. |
| 2003/0209256 | A1 | 11/2003 | Tadayon |
| 2004/0016445 | A1 | 1/2004 | Koch et al. |
| 2004/0100124 | A1 | 5/2004 | Bush |
| 2005/0093339 | A1 | 5/2005 | Klassen |
| 2005/0248208 | A1 | 11/2005 | Boon |
| 2006/0060218 | A1 | 3/2006 | Lakdawala et al. |
| 2006/0081521 | A1 | 4/2006 | Hjerpe et al. |
| 2006/0186186 | A1 | 8/2006 | Kuhn et al. |
| 2006/0219269 | A1 | 10/2006 | Rice et al. |
| 2006/0243308 | A1 | 11/2006 | Asplund et al. |
| 2007/0000528 | A1 | 1/2007 | Asplund et al. |
| 2008/0040872 | A1 | 2/2008 | Hjerpe |
| 2008/0078422 | A1 | 4/2008 | Wagner |
| 2008/0078909 | A1 | 4/2008 | Faircloth |
| 2008/0087300 | A1 | 4/2008 | Kohler et al. |
| 2008/0087301 | A1 | 4/2008 | Lee et al. |
| 2008/0088146 | A1 | 4/2008 | Newman |
| 2008/0135064 | A1 | 6/2008 | Knudsen |
| 2008/0149141 | A1 | 6/2008 | Sales |
| 2008/0156898 | A1 | 7/2008 | Asplund et al. |
| 2008/0173330 | A1 | 7/2008 | Wagner |
| 2008/0178909 | A1 | 7/2008 | Alvestig et al. |
| 2008/0216873 | A1 | 9/2008 | Hjerpe et al. |
| 2008/0250769 | A1 | 10/2008 | Wagner et al. |
| 2008/0272040 | A1 | 11/2008 | Nordlund et al. |
| 2009/0050183 | A1 | 2/2009 | Rice et al. |
| 2009/0260660 | A1 | 10/2009 | Asplund et al. |
| 2009/0283117 | A1 | 11/2009 | Blatch |
| 2010/0031977 | A1 | 2/2010 | Sales |
| 2010/0095984 | A1 | 4/2010 | Tadayon |
| 2010/0242994 | A1 | 9/2010 | Amcoff |
| 2011/0005554 | A1 | 1/2011 | Du Plessis |

FOREIGN PATENT DOCUMENTS

| | | | |
|---|---|---|---|
| WO | 2008025940 | A1 | 3/2008 |
| WO | 2009106792 | A1 | 9/2009 |
| WO | 2009129788 | A2 | 10/2009 |

OTHER PUBLICATIONS

29 CFR 1926.601(b), Regulations Relating to Labor, Occupational Safety and Health Administration, Safety and Health Regulations for Construction, Motor Vehicles, Mechanized Equipment, and Marine Operations, Motor Vehicles, [online] Dec. 2005, retrieved on May 7, 2009, retrieved from the Internet: <URL:http://cfr.vlex.com/vid/1926-601-motor-vehicles-19689298>. Entire document, esp. 29 CFR 1926.601(b)(13)(i).

J. Lynn Lunsford; Airlines Dip Into Hot Water to Save Fuel, Wednesday, Jun. 8, 2008; The Wall Street Journal, two pages.

Aero Jet Wash Facts Newsletters, one page, Nov. 2008.

Andrew BLum, Sure, a Jet's Wings Need Scrubbing, But Its Guts Need a Flush, Too, Dec. 20, 2007, Wired Magazine, two pages.

EFFLUENT COLLECTION UNIT FOR ENGINE WASHING

CROSS REFERENCE TO RELATED APPLICATION(S)

The instant application is a divisional application of U.S. Ser. No. 12/002,981, filed Dec. 19, 2007 and issued as U.S. Pat. No. 8,277,647 on Oct. 2, 2012, entitled EFFLUENT COLLECTION UNIT FOR ENGINE WASHING.

BACKGROUND

The present disclosure is directed to an effluent collection unit for use during engine washing.

Existing engine washing equipment includes a collecting device for capturing the wash effluent. The collecting device is transported on a trailer to an airport, towed to the aircraft, and set up behind the engine. The collecting device is not collection effective on all aircraft variations.

SUMMARY

As described herein, there is provided an effluent collection unit for engine washing. The effluent collection unit broadly comprises a portable trailer having a plurality of sides forming an internal compartment and an effluent collection system positioned within the internal compartment for capturing engine wash water effluent when the trailer is placed in an operational configuration.

Other details of the effluent collection unit, as well as advantages attendant thereto are set forth in the following detailed description and drawings wherein like reference numerals depict like elements.

DETAILED DESCRIPTION OF THE PREFERRED EMBODIMENT(S)

An effluent collection unit is provided that includes a rugged, compact, self-contained, transportable trailer that is easily transformed into an efficient, versatile effluent collecting device.

The effluent collection unit is intended to capture the engine water wash effluent which contains contaminates from the engine cleaning process. The effluent collector unit prevents discharge of contaminated water to the environment and allows the washing of engines at an airport gate, in a hangar, or at other locations in an airport operations area.

The effluent collection unit improves engine wash operations, logistics, safety, and performance. The effluent collection unit may be used with an integrated wash unit which prepares and distributes the engine wash water and recycles the effluent.

Figure 1:
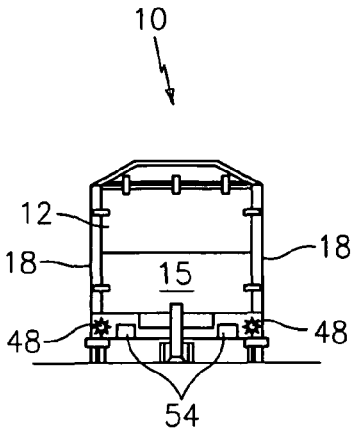
FIG. 1 is a front end view of the effluent collection unit in a stowed position.
Figure 2:
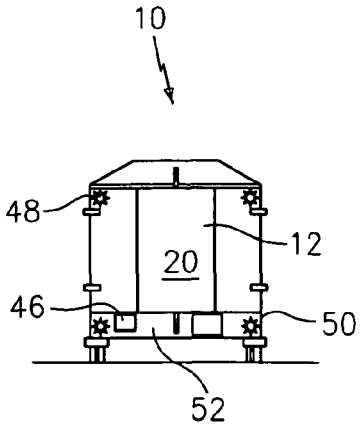
FIG. 2 is a rear end view of the effluent collection unit in a stowed position.
Figure 3:
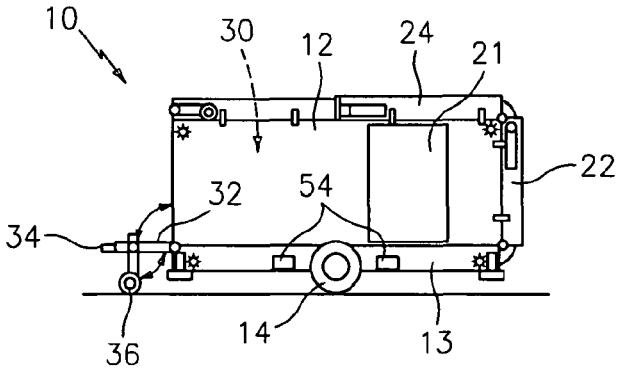
FIG. 3 is a side view of the effluent collection unit in the stowed position.

The effluent collection unit 10 is shown in FIGS. 1-3 in its stowed towing configuration. As can be seen from these figures, the unit 10 includes a trailer 12 having a base 13 to which a plurality of wheels 14 may be mounted. If desired, each of the wheels 14 may be provided with either a power brake or a manually operated brake. The brakes should be independent of the position of a towing bar 32. Further, the base 13 may have a plurality of extendible and retractable legs 16 for stability purposes.

Figure 4:
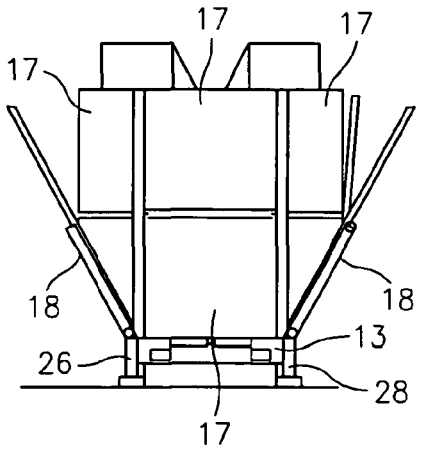
FIG. 4 is an end view of the effluent collection unit in a deployed position.
Figure 5:
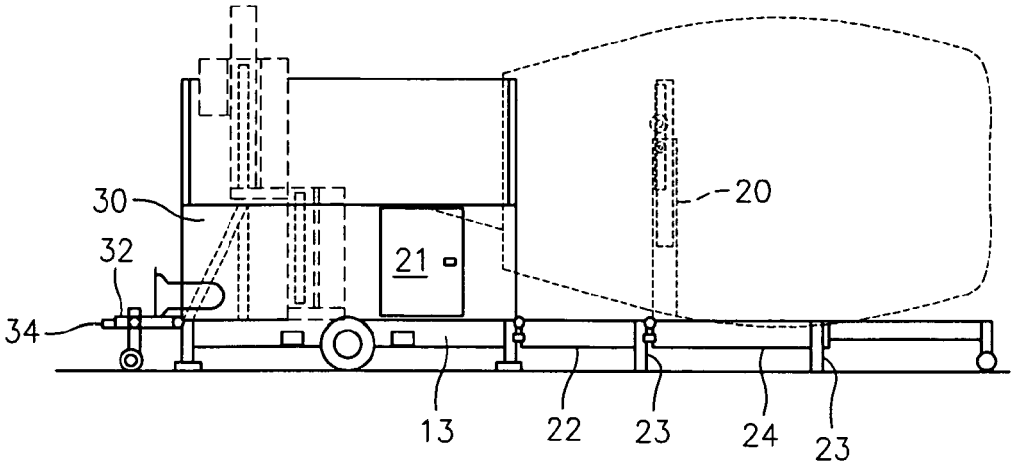
FIG. 5 is a side view of the effluent collection unit in a deployed position.
Figure 6:
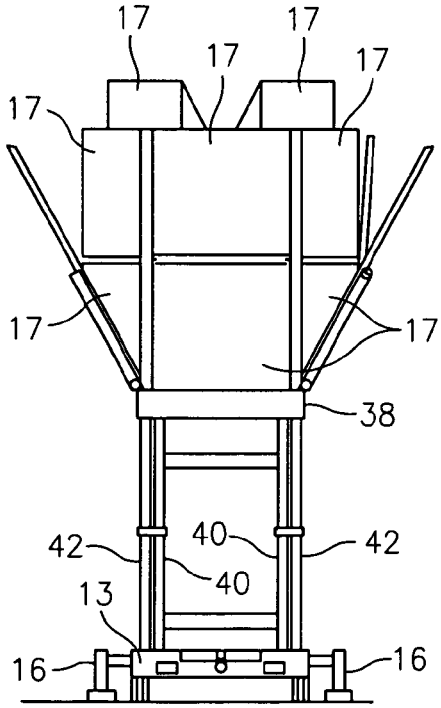
FIG. 6 is an end view of the effluent collection unit in a raised and deployed position.
Figure 10:
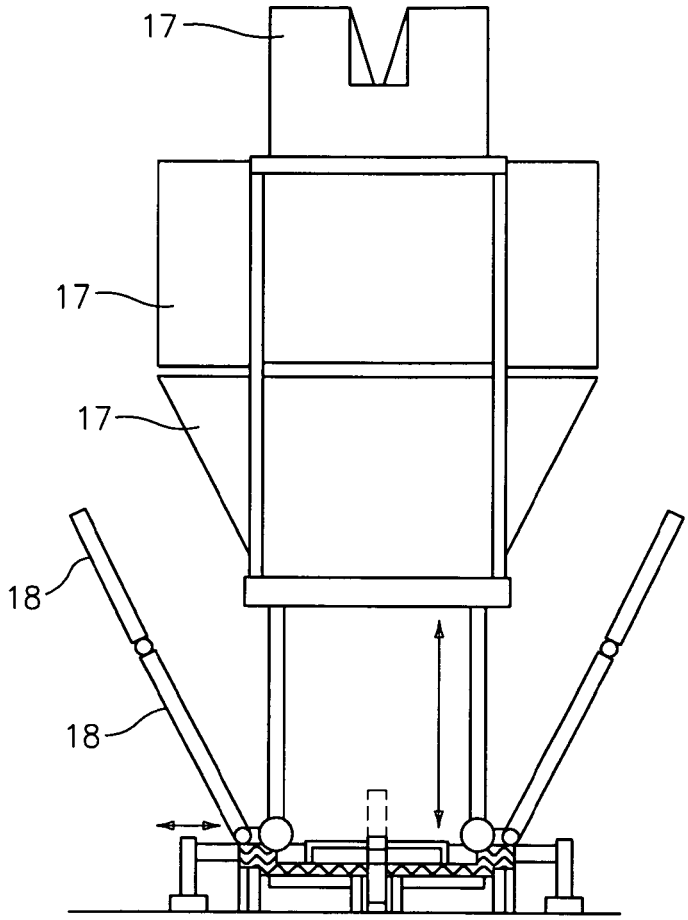
FIG. 10 is an end view of the effluent collection system in a deployed position.
Figure 11:
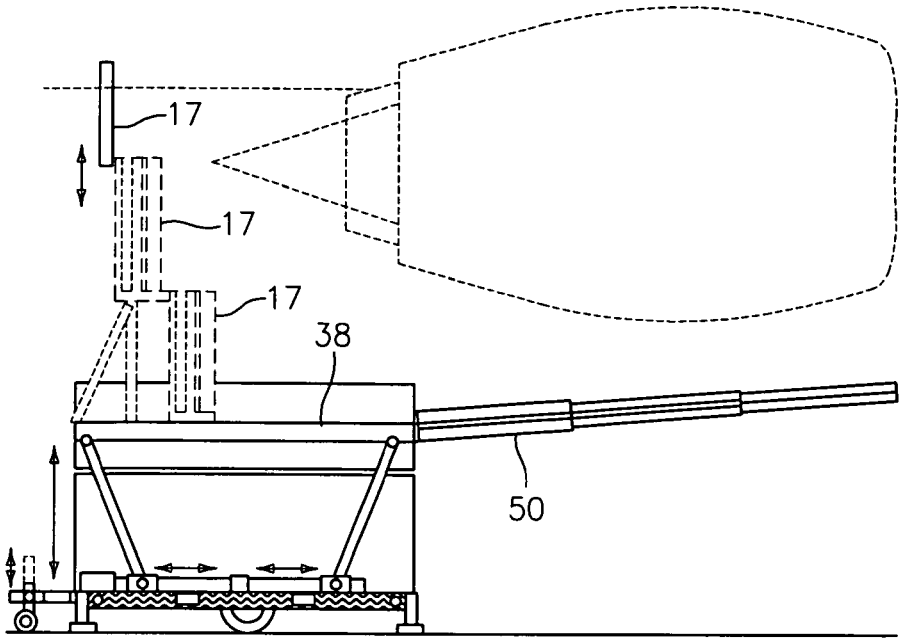
FIG. 11 is a side view of the effluent collection system in a deployed position.
Figure 12:
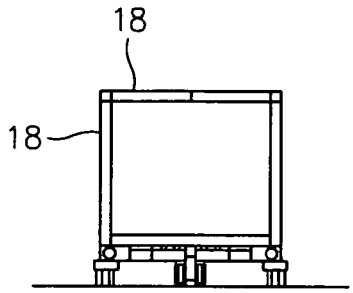
FIG. 12 is a front end view of the effluent collection unit in a stowed position.

The trailer 12 has a front end wall 15, a pair of opposed side walls 18, and an end panel 20 having a first section 22 which forms a rear wall for the trailer and a second section 24 which forms a top panel for the trailer. Behind the front end wall 15 may exist a plurality of droplet separator panels 17 which are moved as shown in FIGS. 4 and 6 to form a wall of droplet separator panels which remove effluent from the air flow. The droplet separator panels 17 may be formed from a droplet separator or adsorption material or profiles that removes droplets from the air flow. As shown in FIG. 4, the opposed side walls 18 may be pivotally mounted to opposed sides 26 and 28 of the base 13 or platform 38 to move between a retracted position where the opposed side walls 18 are substantially perpendicular to the base 13 to a deployed position where each of the side walls 18 is at an angle with respect to the base 13 or platform 38. The side walls 18 may have extendable panels as shown in FIG. 4 or as shown in FIG. 12. The panels may hinge to form at least a portion of the roof of the collection unit when in the stowed configuration or open to form collection surfaces as shown in FIG. 10. The positioning of the side walls 18 around the panels 17 provides a path or duct for channeling or forcing the effluent/air mixture through the panels 17. As shown in FIG. 5, the end panel 20 is movable between a closed position and a deployed position where the first and second sections 22 and 24 are aligned with each other so the sections 22 and 24 may be used as an effluent collection system 50 or trough. Supports 23 may be incorporated into the sections 22 and 24. The supports 23 may be used to position the sections 22 and 24 relative to the ground. As shown in FIG. 11, the effluent collection system 50 may be attached to platform 38 and be self supporting. If desired, power devices may be provided to move the walls 15 and 18 and panel 20 to their deployed positions. Further, suitable locking mechanisms (not shown) may be provided to lock the walls 15 and 18 and panel 20 in their closed position during transport of the trailer 12. When in their closed position, the walls 15 and 18 and the panel 20 form an internal compartment 30 in which the elements of an effluent collection system may be situated.

As shown in FIG. 5, the trailer 12 may have a towing bar 32 attached to a front end of the base 13 for allowing the effluent collection unit 10 to be towed by another vehicle, such as a truck, a forklift, an airport tug, or some other vehicle, or to be manually moved. The towing bar 32 may be adjustable in height. Further, the towing bar 32 may be removably mounted to the base 13 or may be pivotably mounted to the base 13 so that the towing bar 32 is movable between a stowed position and a deployed position. The towing bar 32 may include a receiver 34 for installation of either a pintle hook or ball-type hitch. If desired, a support wheel 36 may be joined to the towing bar 32 to add additional support. The support wheel 36 may also be powered for driving and steering the effluent collection unit into position for use.

Figure 7:
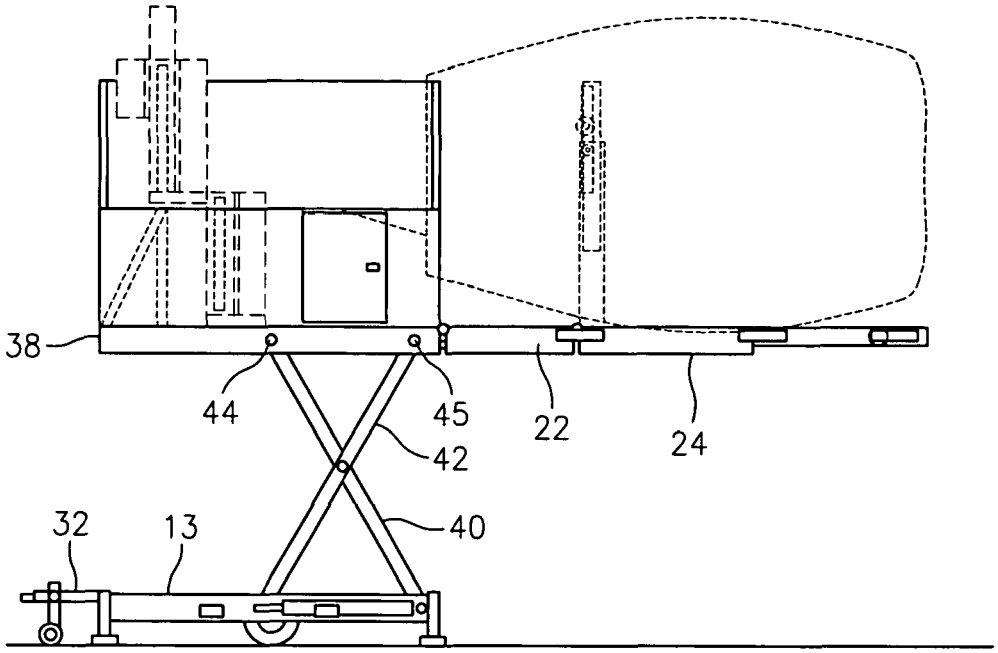
FIG. 7 is a side view of the effluent collection unit in a raised and deployed position.

As shown in FIGS. 6 and 7, the effluent collection unit 10 further includes a platform 38 which is movable relative to the base 13. Any suitable means, such as a forklift, vertical lift, hydraulic cylinders, electrical actuators or a power unit, may be used to move the platform 38 relative to the base 13 or lift the base 13 along with the platform 38. The platform 38 and/or base 13 may be provided with means for securing the platform 38 and/or base 13 to the forks of a forklift, the components of a vertical lift, the lift cylinders or lift actuators to prevent tipping during lifting. The securing means may be clamps, slots, channels and the like attached to or formed in the platform 38 and/or base 13.

As shown in FIGS. 6 and 7, the base 13 may be connected to the platform 38 by two pairs of legs 40 and 42. Each leg 40 may be pivotally joined to the base 13 at one end and may be slidably movable along a track (not shown) formed in the platform 38 via a cam at point 44 attached to leg 40. Each leg 42 also may be pivotally joined to the platform 38 at a point 45. The bottom end of each leg 42 may be slidably movable along the base 13 or pivotally connected to the base 13. For example, the bottom end of each leg 42 may have a cam (not shown) which slides in a track (not shown) formed in a portion of the base 13. Each leg 40 forms an X-shape with a respective leg 42. Further, each leg 40 is pivotally connected to a respective leg 42.

The trailer 12 may have tail lights 46, running lights 48, brake lights 50, fenders 52, and reflectors 54. The unit 10 may be provided with connection points and conversion kits or adapters as required for the lights.

The walls 15 and 18, the end panel 20, the platform 38, and the base 13 may be formed from any suitable waterproof and corrosion resistant material. If desired, personnel access doors or panels 21 may be provided in the walls 15 and 18 and the end panel 20 to access the internal compartment and storage areas within the compartment when the trailer 12 is in its traveling mode. The storage areas may be used to store manifolds, spares, ladders, and storage items.

Figure 8:
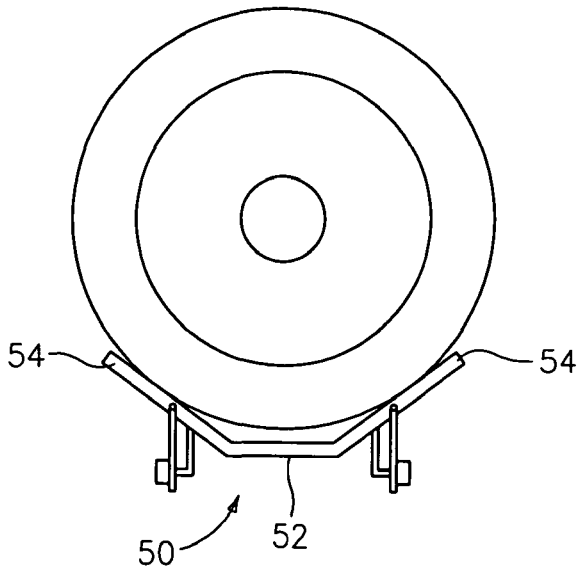
FIG. 8 is an end view of the effluent collection system in a deployed position.
Figure 9:
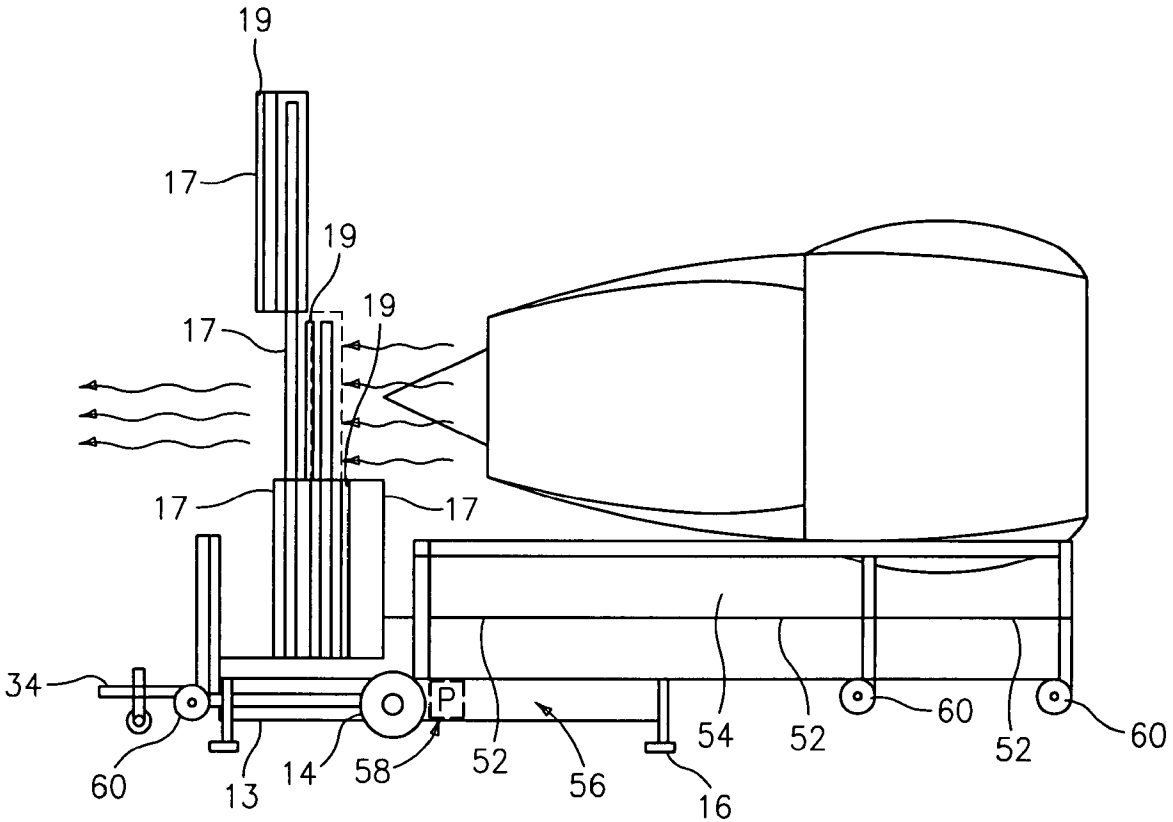
FIG. 9 is a side view of the effluent collection system in a deployed position.

Referring now to FIGS. 8 and 9, the collection unit 12 also has an effluent collection system 50. The effluent collection system 50 may comprise one or more collection devices 52, such as metal troughs, which are placed beneath an engine being washed. The collection devices 52 may be installed on the platform 38 in any desired manner. For example, the devices 52 may be pivotally connected to the platform 38 to move from a stowed position to a raised deployed position. If desired, the collection devices 52 may have fabric or metal panels 54 attached to their sides. The fabric or metal panels 54 may serve as additional effluent gathering panels.

The effluent collection system 50 may also have at least one tank 56 located in base 13 or platform 38 for receiving the effluent gathered by the collection device(s) 52. The collection device(s) 52 may be connected to the tank(s) 56 located in base 13 or platform 38 by any suitable drainage system. A pump 58 may be provided to pump effluent from the tank(s) 56 to a recycling unit or other disposal system which does not form part of the effluent collection system. The pump 58 may be a self priming pump to assist with the transfer of effluent from the tank(s) 56. Suitable fittings and hoses may be provided as needed. The tank(s) 56 may store effluent for at least two engine water wash cycles. The tank(s) 56 may be formed from a corrosion proof and leak proof material and may be protected from puncture damage as needed. The tank(s) 56 may be mounted to the base 13 or platform 38 in any suitable manner.

The effluent collection system 50 may also include a preliminary hydrocarbon adsorption or oil-water separation mechanism that serves as a primary remover of oil from the collected effluent. Lipophilic materials added to or integral with the collection devices and drains are useful. Oil adsorbing pillows, tubes or sheets that float on the effluent may also be used. Still further, skimmers may be used.

The effluent collection unit may have means 19 for removal of mist and contaminates downstream from the droplet separator panels 17 such as mist collection, mist separation, mist absorption and/or mist filtration material placed downstream from the droplet separator panels 17.

The effluent collection unit 10 if desired, may provide a method for removing effluent from the engine exhaust area. A suction hose with a quick connect pipe with tapered tip or flexible hose may be provided for extracting effluent from the engine via a pump or vacuum device.

The effluent collection unit 10 may, if desired, have a built-in adjustable ladder or platform, with non-skid coating, to allow access to the engine exhaust.

The effluent collection unit 10 may be used with a wide variety of commercial and military on-wing and tail mounted engines. The effluent collection unit may collect effluent from the bleed ports, bypass ports, etc. of the engines. If necessary, this may be accomplished with movable and/or extending panels 18, flexible shrouds, supported ducts, and/or diverter plates.

The effluent collection unit described herein has a more rugged design for use in harsh airport environments, improved operator safety, simplified operation, reduced maintenance and more efficient logistics, transportation and storage features.

The effluent collection unit 10 may be easily maneuvered when empty by one person and when full by two or more persons. Further, transfer of the effluent collection unit into its deployed position can be done quickly, i.e. less than 20 minutes.

The effluent collection unit 10 may be positioned under the centerline of the engine. The effluent collection unit 10 may be moved laterally with auxiliary wheels 60 mounted to the base 13, which auxiliary wheels may be lowered or raised. Visual indicators to assist an operator in setup and alignment may be provided.

The effluent collecting unit described herein has improved effluent collection performance and reduced environmental spill potential, improved effectiveness on a greater variety of aircraft engine applications, a compact design which improves logistics and reduces shipping storage costs and requirements, eliminates the need for additional trailers for transportation between airports, allows towing on highways and airport operations areas, prevents rain water from filling collector when stowed, reduced maintenance, ease of assembly and operation, an integrated lifting capability, oil removal from effluent and effluent removal from engine exit area, and provides storage capacity for other spares/supplies.

It is apparent that there has been provided an effluent collection unit for engine washing. While the effluent collection unit has been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A method for collecting effluent from an engine comprising:

providing a portable trailer having a plurality of sides in a retracted and non-operational configuration forming an internal compartment and at least one droplet separator panel; and moving at least two of said sides from said retracted and non-operational configuration to an open position and an operational configuration wherein said two sides create a path for channeling an effluent/air mixture containing engine wash water from said engine to said at least one droplet separator panel; and separating said engine wash water from said air with said at least one droplet separator panel.

2. The method of claim 1, further comprising:

positioning an effluent collection system within said internal compartment when said trailer is in said non-operational configuration; and exposing said effluent collection system by moving said at least two sides so as to capture said engine wash water effluent when said trailer is placed in said operational configuration.

3. The method of claim 1, further comprising:

providing said trailer with an end panel having a first section forming a rear end of said trailer and a second section forming a top panel for said trailer; and forming an effluent collection system for said engine wash water by deploying said first section so as to be aligned with said second section.

4. The method of claim 2, further comprising providing a platform for supporting said effluent collection system and a frame structure.

5. The method of claim 4, further comprising moving said platform relative to said frame for placing said trailer in said operational position.

6. The method of claim 2, further comprising forming said effluent collection system from at least one collection trough.

7. The method of claim 6, further comprising forming said at least one collection trough from metal or a fabric chute.

8. The method of claim 1, further comprising forming said at least one droplet separator panel from a droplet separator or adsorption material or profiles that remove droplets from the effluent/air mixture.

9. The method of claim 1, further comprising providing said trailer with a preliminary hydrocarbon absorption and oil-water separation device and an oil collection device.

10. The method of claim 1, further comprising providing said trailer with a plurality of droplet separator panels and means for removing mist and contaminates downstream from the droplet separator panels by at least one of mist collection, mist separation, mist absorption and/or mist filtration material placed downstream from the droplet separator panels.

* * * * *